US006693989B2

(12) United States Patent
Rhodes et al.

(10) Patent No.: US 6,693,989 B2
(45) Date of Patent: Feb. 17, 2004

(54) ULTRABRIGHT MULTIKILOVOLT X-RAY SOURCE: SATURATED AMPLIFICATION ON NOBLE GAS TRANSITION ARRAYS FROM HOLLOW ATOM STATES

(75) Inventors: Charles K. Rhodes, Chicago, IL (US); Keith Boyer, Santa Fe, NM (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 0 days.

(21) Appl. No.: 09/954,635

(22) Filed: Sep. 14, 2001

(65) Prior Publication Data

US 2002/0146091 A1 Oct. 10, 2002

Related U.S. Application Data

(60) Provisional application No. 60/232,567, filed on Sep. 14, 2000.

(51) Int. Cl.[7] ..... H61J 35/08

(52) U.S. Cl. ..... 378/119; 378/124; 378/143

(58) Field of Search ..... 378/119, 143, 378/124

(56) References Cited

U.S. PATENT DOCUMENTS

| | | | | | |
|---|---|---|---|---|---|
| 4,723,262 | A | * | 2/1988 | Noda et al. | 378/119 |
| 5,459,771 | A | * | 10/1995 | Richardson et al. | 378/119 |
| 5,487,078 | A | | 1/1996 | Rhodes et al. | 372/5 |
| 5,577,091 | A | * | 11/1996 | Richardson et al. | 378/119 |
| 5,577,092 | A | * | 11/1996 | Kublak et al. | 378/119 |
| 5,991,360 | A | * | 11/1999 | Matsui et al. | 378/119 |
| 6,002,744 | A | * | 12/1999 | Hertz et al. | 378/119 |
| 6,285,743 | B1 | * | 9/2001 | Kondo et al. | 378/119 |
| 6,304,630 | B1 | * | 10/2001 | Bisschops et al. | 378/119 |
| 6,324,256 | B1 | * | 11/2001 | McGrego et al. | 378/119 |
| 6,377,651 | B1 | * | 4/2002 | Richardson et al. | 378/119 |

OTHER PUBLICATIONS

Borisov, A.B., McPherson, A., Thompson, B.D., Boyer, K., Rhodes, C.K., "Ultrahigh power compression for x–ray amplification: multiphoton cluster excitation combined with non–linear channeled propagation," *Journal of Physics*, vol. 28, 1995, pp. 2143–2158.

McPherson, A., Thompson, B.D., Borisov, A.B., Boyer, K., Rhodes, C.K., "Multiphoton–induced x–ray emission at 4–5 keV from Xe atoms with multiple core vacancies," Department of Physics, University of Illinois at Chicago, *Letters to Nature*, vol. 370, Aug. 25, 1994, pp. 631–634.

Kondo, K., Borisov, A.B., Jordan, C., McPherson, A., Schroeder, W.A., Boyer, K., Rhodes, C.K., "Wavelength dependence of multiphoton–induced Xe(M) and Xe(L) emissions from Xe clusters," Letter to the Editor, *Journal of Physics*, vol. 30, No. 18, 1997, pp. L2707–L2716.

(List continued on next page.)

*Primary Examiner*—Edward J. Glick
*Assistant Examiner*—Irakli Kiknadze
(74) *Attorney, Agent, or Firm*—Samuel M. Freund; The Law Offices of William W. Cochran, LLC

(57) ABSTRACT

An apparatus and method for the generation of ultrabright multikilovolt x-rays from saturated amplification on noble gas transition arrays from hollow atom states is described. Conditions for x-ray amplification in this spectral region combine the production of cold, high-Z matter, with the direct, selective multiphoton excitation of hollow atoms from clusters using ultraviolet radiation and a nonlinear mode of confined, self-channeled propagation in plasmas. Data obtained is consistent with the presence of saturated amplification on several transition arrays of the hollow atom Xe(L) spectrum ($\lambda$~2.9 Å). An estimate of the peak brightness achieved is ~$10^{29}$ $\gamma \cdot s^{-1} \cdot mm^{-2} \cdot mr^{-2}$ (0.1% Bandwidth)$^{-1}$, that is ~$10^5$-fold higher than presently available synchotron technology.

14 Claims, 11 Drawing Sheets

OTHER PUBLICATIONS

Borisov, A.B., Borovskiy, A.V., Korobkin, V.V., Prokhorov, A.M., Shiryaev, O.B., Shi, X.M., Luk, T.S., McPherson, A., Solem, J.C., Boyer, K., Rhodes, C.K., "Observation of relativistic and charge–displacement self–channeling of intense subpicosecond ultraviolet (248 nm) radiation in plasmas," Laboratory for Computer Simulation, Research Computer Center, Moscow State University, Moscow, Russia, General Physics Institute, Academy of Sciences of Russia, Moscow, Russia, Department of Physics, University of Illinois at Chicago, Illinois, Theoretical Division, Los Alamos National Laboratory, Los Alamos, New Mexico, *Physical Review Letters*, vol. 68, No. 15, Apr. 13, 1992.

Borisov, A.B., Longworth, J.W., Boyer, K., Rhodes, C.K., "Stable relativistic/charge–displacement channels in ultra-high power density (≈1021W/cm3) plasmas," *Proc. National Academy of Sciences*, vol. 95, Jul. 1998, pp. 7854–7859.

Borisov, A.B., McPherson, A., Boyer, K., Rhodes, C.K., "Z–λ of Xe(M) and Xe(L) emissions from channeled propagation of intense femtosecond 248 nm pulses in a Xe cluster target," Letter to the Editor, *Journal of Physics*, vol. 29, 1996, pp. L113–L118.

McPherson, A., Borisov, A.B., Boyer, K., Rhodes, C.K., "Competition between multiphoton xenon cluster excitation and plasma wave Raman scattering at 248 nm," Letter to the Editor, *Journal of Physics*, vol. 29, 1996, pp. L291–L297.

Borisov, A.B., McPherson, A., Boyer, K., Rhodes, C.K., "Intensity dependence of the multiphoton–induced Xe(L) spectrum produced by subpicosecond 248 nm excitation of Xe clusters," Letter to the Editor, *Journal of Physics*, vol. 29, 1996, pp. L43–L50.

McPherson, A., Cobble, J., Borisov, A.B., Thompson, B.D., Omenetto, F., Boyer, K., Rhodes, C.K., "Evidence of enhanced multiphoton (248 nm) coupling from single–pulse energy measurements of Xe(L) emission induced from Xe clusters," Letter to the Editor, *Journal of Physics*, vol. 30, No. 17, 1997, pp. L767–L775.

Borisov, A.B., Shi, X.M., Karpov, V.B., Korobkin, V.V., Solem, J.C., Shiryaev, O.B., McPherson, A., Boyer, K., Rhodes, C.K., "Stable self channeling of intense ultraviolet pulses in underdense plasma, producing channels exceeding 100 Rayleigh lengths," *Journal of Optical Society of America*, vol. 11, No. 10, Oct. 1994, pp. 1941–1947.

Boyer, K., Rhodes, C.K., "Atomic inner–shell induced by coherent motion of outer–shell electrons," Department of Physics, University of Illinois at Chicago, *Physical Review Letters*, vol. 54, No. 14, Jan. 28, 1985, pp. 1490–1493.

Schroeder, W.A., Omenetto, F.G., Borisov, A.B., Longworth, J.W., McPherson, A., Jordan, C., Boyer, K., Kondo, K., Rhodes, C.K., "Pump laser wavelength–dependent control of the efficiency of kilovolt x–ray emission from atomic clusters," *Journal of Physics*, vol. 31, 1998, pp. 5031–5051.

Schroeder, W.A., Nelson, T.R., Borisov, A.B., Longworth, J.W., Boyer, K., Rhodes, C.K., "An efficient, selective collisional ejection mechanism for inner–shell population inversion in laser–driven plasmas," *Journal of Physics B: Atomic, Molecular and Optical Physics*, vol. 34, 2001, pp. 297–319.

Borisov, A.B., Borovskiy, A.V., Shiryaev, O.B., Korobkin, V.V., Prokhorov, A.M., Solem, J.C., Luk, T.S, Boyer, K., Rhodes, C.K., "Relativistic and charge–displacement self channeling of intense ultrashort laser pulses in plasmas," Physical Review A, vol. 45, No. 8, Apr. 15, 1992, pp. 5830–5845.

Plechaty, E.F., Cullen, D.E., Howerton, R.J., "Tables and Graphs of Photon–Interaction Cross Sections from 0.1 keV to 100 MeV Derived from the LLL Evaluated–Nuclear–Data Library," *Lawrence Livermore Laboratory*, Nov. 11, 1981.

Omenetto, F.G., Boyer, K., Longworth, J.W., McPherson, A., Nelson, T., Noel, P., Schroeder, W.A., Rhodes, C.K., Szatmari, S., Marowsky, G., "High–brightness terawatt KrF* (248 nm) system," *Applied Physics B*, vol. 64, 1997 pp. 643–646.

Cowan, Robert D., "The theory of Atomic Structure and Spectra," *University of California Press*, Sep., 1981.

Wagner, R., Chen, S–Y, Maksimchuk, A., Umstadter, D., "Electron acceleration by a laser wakefield in a relativistically self guided channel," Center for Ultrafast Optical Science, Physical Review Letters, *The American Physical Society*, vol. 78, No. 16, 1997, pp. 3125–3128.

Wang, X., Krishnan, M., Saleh, N., Wang, H., Umstadter, D., "Electron acceleration and the propagation of ultrashort high–intensity laser pulses in plasmas," Physical Review Letters, *The American Physical Society*, vol. 84, No. 23, Jun. 5, 2000, pp. 5324–5327.

Marowsky, G., Rhodes, C.K., "Hohle Atome–Eine Neue Form von Hochangeregter Materie," Neue Zürcher Zeitung, No. 254, Nov. 1, 1995, S.42, no translation.

* cited by examiner

ULTRABRIGHT MULTIKILOVOLT X-RAY SOURCE: SATURATED AMPLIFICATION ON NOBLE GAS TRANSITION ARRAYS FROM HOLLOW ATOM STATES

RELATED CASES

The present patent application claims the benefit of Provisional Patent Application Serial No. 60/232,567 filed on Sep. 14, 2000 for "Ultrabright Multikilovolt X-ray Source: Saturated Amplification On Xe(L) Transition Arrays At $\lambda \approx 2.9$ ÅFrom Hollow Atom States".

STATEMENT REGARDING FEDERAL RIGHTS

This invention was made in part with government support under grant DEAC04-94-AL8500 by the Department of Energy and grants DAAH04-94-G-9989 and DAAG55-97-1-0310) by the Army Research Office. The government has certain rights in the invention.

FIELD OF THE INVENTION

The present invention relates generally to x-ray lasers and, more particularly, to an ultrabright multikilovolt x-ray source which is based on the direct multiphoton excitation of hollow atoms from clusters using ultraviolet radiation, combined with a nonlinear mode of confined propagation or self-channeling.

BACKGROUND OF THE INVENTION

Detailed molecular structural information is of enormous significance to the medical and biological communities. Since hydrated biologically active structures are small delicate complex three-dimensional (3D) entities, it is essential to have molecular scale spatial resolution, high contrast, distortionless, direct 3D modalities of visualization of specimens in the living state in order to faithfully reveal their full molecular architectures. An x-ray holographic microscope equipped with an x-ray laser as the illuminator would be uniquely capable of providing these images [1,2] and would have a peak brightness that is ~$10^5$-fold higher than presently available synchrotron technology [3].

Accordingly, it is an object of the present invention to provide an apparatus and method for producing an ultrabright multikilovolt x-ray source.

Another object of the invention is to provide an apparatus and method for amplifying x-rays in the multikilovolt spectral region.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the method for generating laser radiation in the x-ray region of the electromagnetic spectrum hereof includes: generating pulsed laser radiation having a chosen intensity and wavelength; generating gaseous atomic clusters having a chosen density and size; and directing the laser radiation into the gas clusters whereby multiphoton coupling with the clusters occurs producing rapid atomic excitation, thereby removing selected inner-shell atomic electrons without removing all of the electrons in the next outermost shell with the consequent generation of a population inversion, and whereby a nonlinear mode of confined propagation for x-radiation is produced.

In another aspect of the present invention in accordance with its objects and purposes, the apparatus for generating laser radiation in the x-ray region of the electromagnetic spectrum includes: means for generating pulsed laser radiation having a chosen intensity and wavelength; means for generating gaseous atomic clusters having a chosen density and size; and means for directing the laser radiation into the gas clusters whereby multiphoton coupling with the clusters occurs producing rapid atomic excitation, thereby removing selected inner-shell atomic electrons without removing all of the electrons in the next outermost shell with the consequent generation of a population inversion and the production of a nonlinear mode of confined propagation for x-radiation.

Benefits and advantages of the invention include the generation of multikilovolt x-radiation suitable for nanoscale imaging applications.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

Briefly, the present invention includes an apparatus and method for the amplification of multikilovolt x-rays experimentally demonstrated at $\lambda$=2.9 Å that proves the feasibility of a compact x-ray illuminator that can achieve the mission of x-ray biological microholography and likewise serve an array of other applications involving the fabrication and measurement of solid state nanostructures. An estimate of the peak brightness achieved in these initial experiments gives a value of $\sim 10^{29}\ \gamma \cdot s^{-1}\ mm^{-2} \cdot mr^{-2}(0.1\%\ Bandwidth)^{-1}$, a magnitude that is $\sim 10^5$-fold higher than presently available synchrotron technology [3].

Conditions for x-ray amplification in the multikilovolt spectral region combine the production of cold, low opacity, spatially directionally organized, and vigorously ($10^{19}$–$10^{20}$ W/cm$^3$) inner-shell state-selectively excited high-Z matter. The results reported hereinbelow establish that the alliance [4] of two recently studied phenomena: (a) the direct multiphoton excitation of hollow atoms from clusters [5] with ultraviolet radiation [6] and (b) a nonlinear mode of confined propagation in plasmas resulting from relativistic/charge-displacement self-channeling [7,8], can successfully produce the union of this demanding set of requirements.

Experimental evidence [4–7, 9–13] and corresponding theoretical analyses [8, 14–17] have led to the conclusion that the hollow atom Xe(L) emission at $\lambda$=2.9 Å generated by 248 nm excitation of Xe clusters [5] in a self-trapped channel closely represents the conditions sought for x-ray amplification. See also "Bifurcation Mode Of Relativistic And Charge-Displacement Self-Channeling" by A. B. Borisov et al., J. Phys. B: At. Mol. Opt. Phys. 34 (2001) 2167–2176, the teachings of which are hereby incorporated by reference herein. Specifically, on the basis of: (a) a detailed examination of Xe(L) spectral data [6, 9, 11]; (b) theoretical analyses of the mechanisms of cluster excitation [4, 14–16] and channeled propagation [4, 8, 17]; and (c) calibrated measurements of the Xe(L) energy yield [12], the exponential gain constant, $g_L$, is estimated to reach a value of $g_L$=60±20 cm$^{-1}$, a range approximately two orders of magnitude above the competing absorptive losses [18]. The measurements described hereinbelow confirm these assessments.

Reference will now be made in detail to the preferred embodiments of the present invention examples of which are illustrated in the accompanying drawings.

Figure 1:
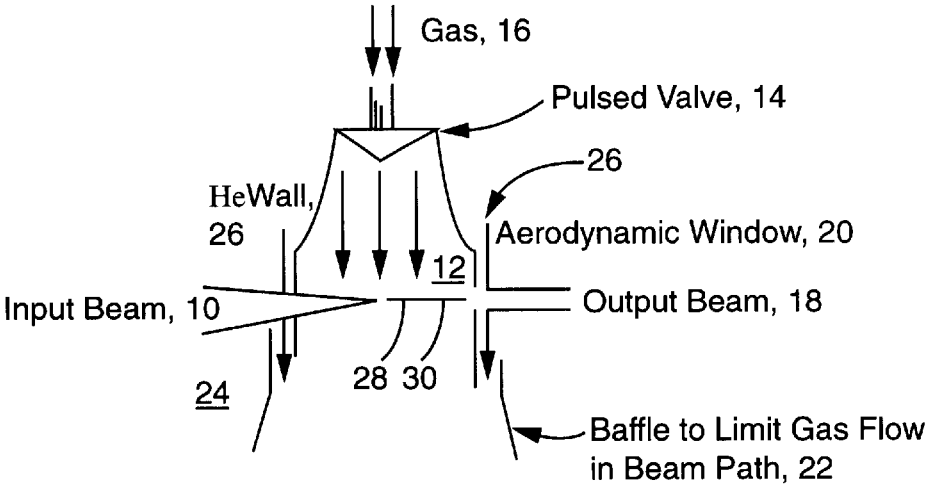
FIG. 1 is a schematic representation of the apparatus utilized for the observation of the amplification of Xe(L) radiation in self-trapped channels.

A schematic representation of the apparatus used to demonstrate x-ray lasing is shown in FIG. 1. The femtosecond ultraviolet (248 nm) source employed (See, e.g., Reference [19] hereof and U.S. Pat. No. 5,487,078 which issued to Charles K. Rhodes and Keith Boyer on Jan. 23, 1996, the teachings of both references being hereby incorporated by reference herein), not shown in FIG. 1, delivers a light pulse, 10, having an energy of ~400 mJ at a rate of 0.4 Hz, a temporal duration of ~230 fs, and a peak brightness of $\sim 8.5\times 10^{21}\ W \cdot cm^{-2} \cdot sr^{-1}$. The gaseous xenon cluster target, 12, [4,5] was provided using a pulsed valve, 14, having an aperture of 1.5 mm which was operated at a maximum gas backing pressure, 16, of ~125 psia, a method that produced an average Xe density of between ~3 and $6\times 10^{19}$ cm$^{-3}$. The incident ultraviolet radiation was focused into the cluster medium using an f/3 off-axis parabolic optic, not shown in FIG. 1, and x-ray and other electromagnetic radiation, 18, exited the apparatus through opening, 20. The x-ray spectra were recorded in third-order diffraction [9] using two identical von Hámos spectrographs equipped with mica crystals and Kodak RAR 2492 film, not shown in FIG. 1. Baffle, 22, was used to control gas flow in the beam path. Outside of the region of high gas density 12 is a region of much lower gas density, 24, for some applications separated therefrom by a flowing "wall" of helium, 26.

As stated hereinabove, the x-ray beam forms a self-trapping channel, 28, in the target gas. As further understood by the present inventors, this channel acts as a dielectric waveguide whose properties control the beam propagation. The direction of propagation is sensitive to small changes in electron and gas density profiles, which are not well controlled so the direction of the beam leaving the channel can also change from an axial to $4\pi$ mode by shifting frequency to extinguish the beam. One way in which this effect can be minimized is to terminate the channel in a sharp gas density gradient to essentially zero density, 30, in a smooth plane known as an aerodynamic window. This effect can be achieved by placing a hole in the baffle wall which is in communication with a lower pressure region or a flow of helium gas. In addition to permitting x-radiation to exit the apparatus, opening 20 serves as such an aerodynamic window. Other density gradients may need adjusting for optimum performance.

A channel 28 is produced when the pondermotive potential pushes the free electrons out of the most intense part of the beam creating a positive index gradient at the beam center which augments the index gradient due to the relativistic mass increase of the electrons. This causes self-focusing of the beam which can be stable. The channel diameter is several ultraviolet wavelengths across and requires a critical ultraviolet power level [$P_{cr}=1.61\times 10^{10}(\omega/\omega_p)^2$ Watts, where $\omega$ is the ultraviolet optical frequency and $\omega_p$ plasma frequency] to establish itself and the necessary electron density. See, e.g., A. B. Borisov et al. (2001), supra. The x-ray pulse seeks a guided mode in the dielectric waveguide created by the channel. Its characteristics are determined by the gas density and the electron density. For x-ray frequencies below a cut-off frequency the waveguide acts as a radiator, while for frequencies greater than the cut-off frequency, the waveguide channels the x-radiation. As stated hereinabove, by placing inserting an aerodynamic window in the path of the ultraviolet radiation, a stable configuration for the x-rays is established.

It is known further that the amplitude of the quiver motion of the exciting electrons should be less than the size of the clusters so that each driven electron returns to its cluster rather than be lost and its effect is coherent with others of the cluster. This condition occurs when the pump laser operates in the ultraviolet region at less than ~300 nm. This has been found to increase the x-ray yield by greater than 3 orders of magnitude.

Figure 2:
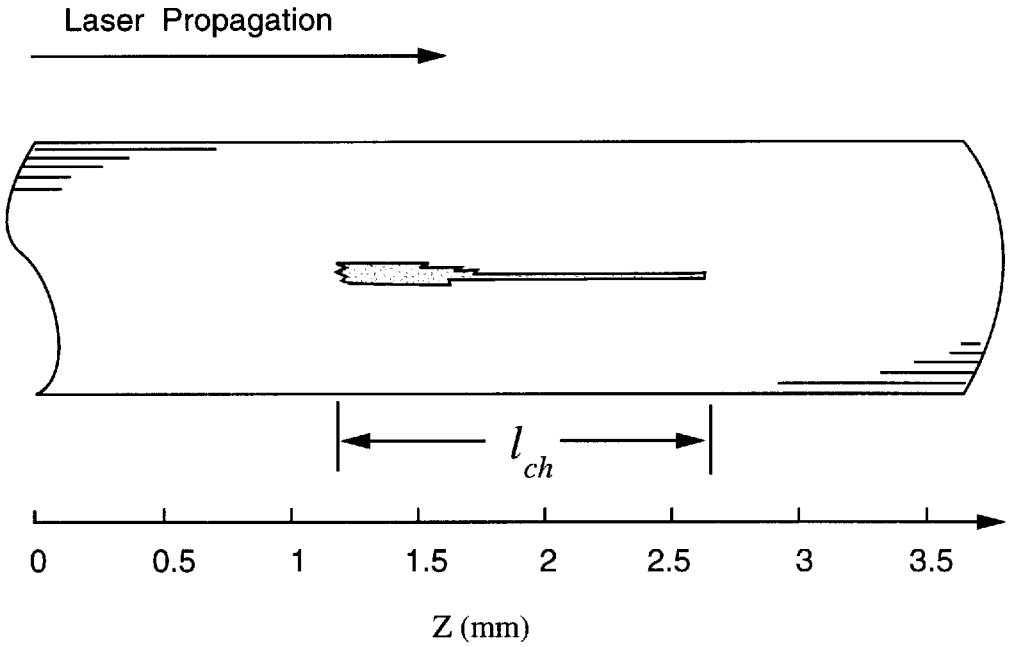
FIG. 2 shows a single-exposure x-ray image of a stable slender channel emitting Xe(M) radiation (~1 keV)produced in a gaseous target containing $(Xe)_n$ clusters.

The single-pulse image in FIG. 2 observed with an x-ray pinhole camera illustrates the characteristic morphology of the confined channels that can be produced in a gaseous Xe cluster target in the present apparatus [4,13,16]. These channels control a large power density. Evaluation of the coupling between the channeled ultraviolet radiation and the clusters [9,11] indicates an atom-specific power of 1 W/atom, a value considerably greater than that characteristic of a vigorous thermonuclear environment. The incorporation of the length indicated by the ~1 keV Xe(M) emission ($I_{ch}\cong 1.5$ mm) with the bounds given hereinabove for the gain constant $g_L$ yields an exponent for amplification in the range $6\leqq g_L I_{ch}\leqq 12$. The range of this estimate is sufficient for the observation of saturated amplification in a channel of the form shown in FIG. 2.

The incident 248 nm pulse for this recording had a duration of ~250 fs, an energy of ~350 mJ, and was focused with f/3 off-axis parabolic mirror. The image was recorded with an x-ray pinhole camera having an aperture with a diameter of 25 $\mu$m and aspatial resolution of ~30 $\mu$m. The observed length of the channel ($I_{ch}$≅1.5 mm) exceeds 50 Rayleigh ranges. Additional experimental details are reported in Ref [8]. The color scale (in arbitrary units) of the measured x-ray intensity is defined by black, zero; red through violet, ascending intensity; and white, maximum. Image adapted from Ref. [8] and included with permission.

Experimental data of several forms have been obtained which constitute evidence of amplification on several transitions of the hollow-atom Xe(L) spectrum (λ~2.9 Å). Specifically, they are: (1) enhanced gain-narrowed spectra for $Xe^{34+}$, $Xe^{35+}$, and $Xe^{36+}$ species recorded from a channel in the forward (axial) direction; (2) evidence for saturation of these three transition arrays given by the simultaneous quenching of the corresponding spontaneous emission therefrom in transversely recorded spectra only when amplifying channels are present, observations that correlate fully with the measured spectral narrowing; and (3) gross structural damage to 12.5 $\mu$m thick Ti foils located at a separation of ~2.5 cm from the source in the forward direction. In the latter case, holes pierced in the foil having a diameter of ~15 $\mu$m have been observed; this is a value that corresponds to a divergence of ~6 times that expected from a coherent aperture formed by the channel.

Figure 3:
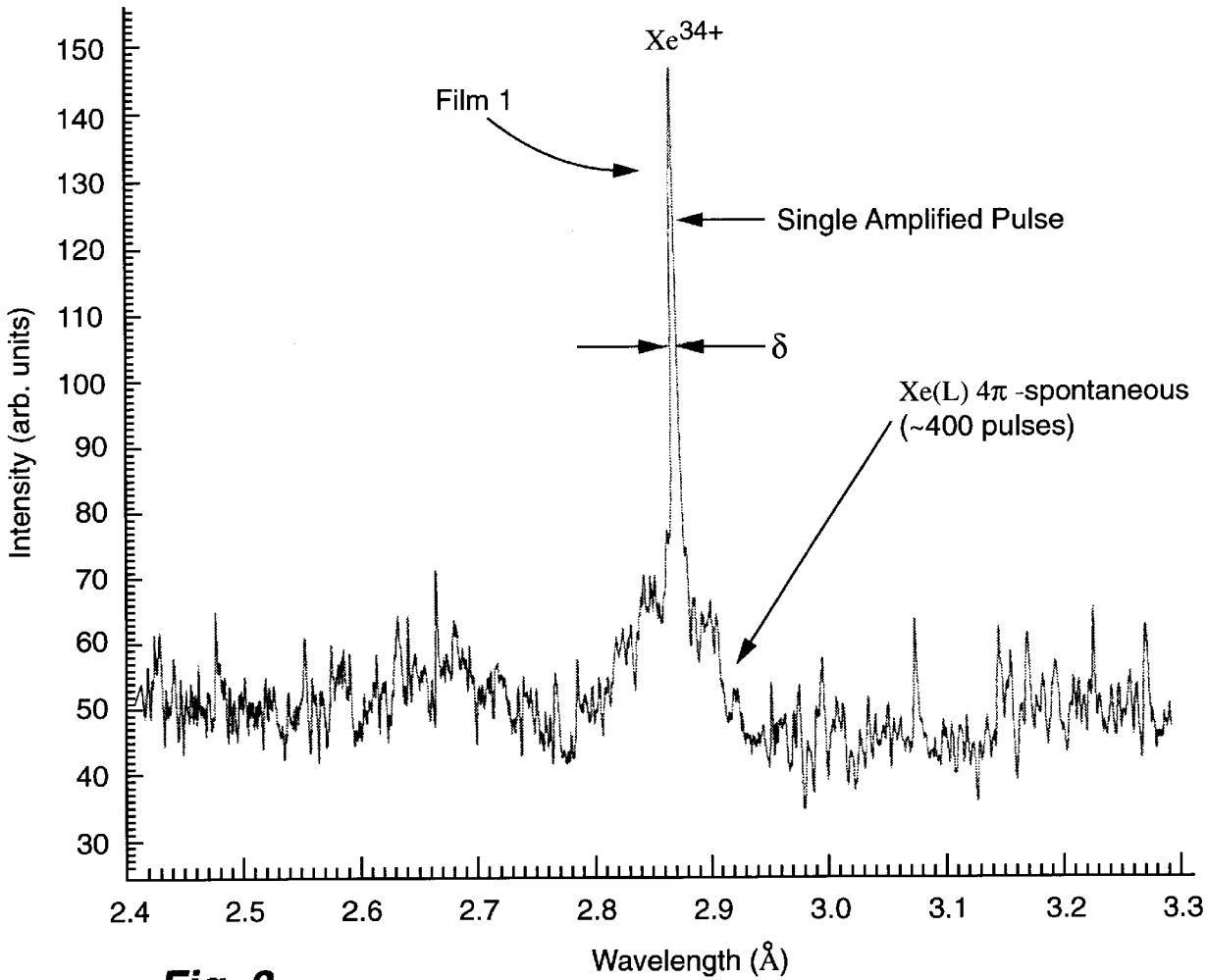
FIG. 3 shows the Xe(L) spectrum (film #1) recorded with a mica von Hamos spectrometer in the forward (axial) direction from a channel. A single amplified $Xe^{34+}$ pulse ($\lambda$=2.88 Å) is recorded along with ~400 pulses of isotropically radiated spontaneous emission.

This damage to the foil, or any other object located in the beam, is unavoidable, since the data show that the system is saturated and consequently produces a minimum output of ~230 J/cm$^2$. No known material can withstand irradiation with multikilovolt x-rays at this level when delivered in a period of time of ~100 fs or less, without sustaining heavy damage. This means that a von Hámos spectrometer, which uses diffraction from a mica crystal and requires satisfaction of the Bragg condition, will only record a single, properly directed pulse since the incident x-ray energy will destroy the crystalline structure at the location that enables the Bragg geometry to be satisfied. Hence, under alignment conforming to the Bragg condition for a narrowly directed beam of radiation, a spectrum (film #1) of the type shown in FIG. 3 is produced. Since ~400 pulses were used to record these data, the large observed peak corresponding to the $Xe^{34+}$ transition array should be enhanced further by a factor of ~400 over the background of isotropically radiated spontaneous emission shown. This relative enhancement over the spontaneous emission is likely even greater, since the damage terminates diffraction during the pulse. For example, with the assumption of a 50 fs pulse of x-rays and an induced atomic velocity in the damaged zone of only ~$10^{+5}$ cm/s, the corresponding displacement would be ~0.5 Ψ, a value far larger than that needed to eliminate the diffractive scattering for the narrow bandwidth (δ~8.4 eV FWHM) of the dominant amplified feature shown at λ≅2.88 Å.

The intrinsic brightness of the source demands that modified procedures be developed for the recording of a high-resolution spectrum with a diffractive instrument. In order to remove the limitation arising from damage to the crystal, the spectrum was recorded under non-Bragg conditions for the directed beam by utilizing the fact that a small fraction of the radiation is scattered into an angular cone about the direction of propagation. Although this scattered component is quite weak at the angles experimentally employed, the experimental procedure involving slightly imperfect alignment was found to work, although the contrast ratio between the amplified, axially directed spectral components and the isotropically produced spontaneous emission is greatly reduced.

Figure 4:
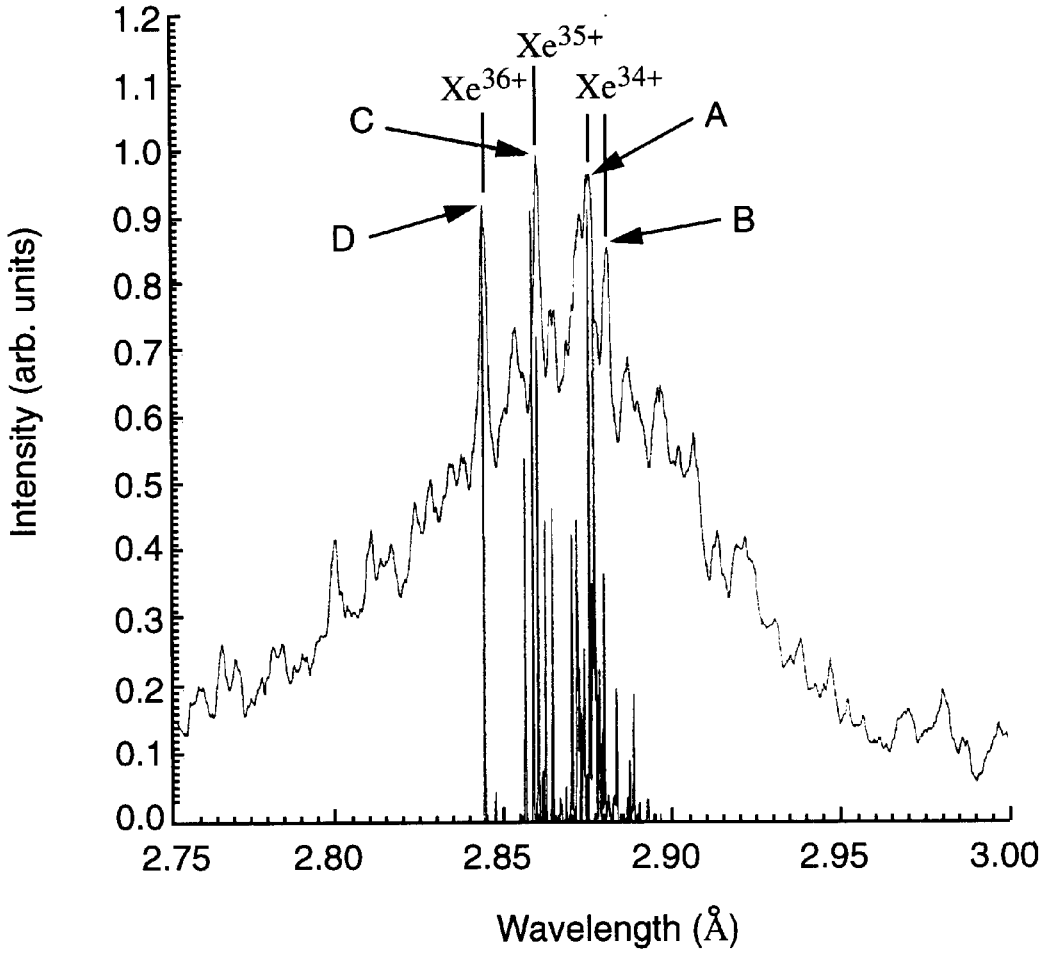
FIG. 4 shows the amplified Xe(L) spectrum observed (film #2) under non-Bragg conditions with a mica von Hámos spectrometer in the forward (axial) direction from a channel having a length of ~2 mm.

The experimental result (film #2) obtained with the use of this technique is shown in FIG. 4. Several strong sharp spectral features corresponding to the $Xe^{34+}$, $Xe^{35+}$, and $Xe^{36+}$ transition arrays are clearly seen that differ significantly from the normally observed, unamplified Xe(L) spontaneous emission spectrum [6,9,11]. FIG. 4 was obtained under non-Bragg conditions with a mica von Hámos spectrometer in the forward (axial) direction from a channel having a length of ~2 mm. Several sharp features corresponding to the designated $Xe^{q+}$ ion charge states are manifest, particularly the four lines (A–D) identified for q=34–36. The inset shows an expansion of the spectrum illustrating the comparison of the observed wavelengths with the corresponding calculated positions of the $Xe^{34+}$, $Xe^{35+}$, and $Xe^{36+}$ transition arrays. The vertical heights of the computed wavelengths are given by normalized gA values of the corresponding components as defined in Ref. [20]. Since $Xe^{36+}$ has an electron configuration similar to Ar, this feature represents a single transition. The measured width (FWHM) of ~4.4 eV for the $Xe^{36+}$ line is in good accord with the instrumental width estimated in Ref. [9] as ~5 eV.

Based on the spectroscopic properties of the corresponding transition arrays, the observed spectral widths of the $Xe^{34+}$, $Xe^{35+}$, and $Xe^{36+}$ features shown in FIG. 4, individually exhibit several characteristics that are signatures of amplification. The TABLE presents the measured widths (FWHM) and transition array multiplicities of four well-resolved components. For example, spectral analysis the data for the $Xe^{36+}$ system which is Ar-like, shows [20] that the $Xe^{36+}$ transition at λ≅2.845 Å is composed of a single strong component.

TABLE

| Radiating Ion | Central Wavelength (Å) | Width (FWHM, eV) | Number of Components in Transition Array (3d → 2p) |
|---|---|---|---|
| $Xe^{34+}$ | λ = 2.88 (A) | 9.8 | |
| | λ = 2.88 (B) | 4.9 | 466 |
| $Xe^{35+}$ | λ = 2.86 (C) | 4.5 | 60 |
| $Xe^{36+}$ | λ = 2.84 (D) | 4.4 | 3 |

Accordingly, it is significant that this line (feature D) displays a sharp symmetric peak with a width (~4.4 eV) that is consistent with the spectral resolution (~5 eV) of the von Hámos instrument estimated in prior work [9]. Given its minimal spectroscopic structure, the $Xe^{36+}$ line should also be the narrowest transition observed, an expectation that is fulfilled. By contrast, the $Xe^{34+}$ array which consists of many transitions [20] in a very complex overlapping pattern, produces two principal amplified components (features A and B) with different widths that are both larger than the instrumental limit indicated by the isolated $Xe^{36+}$ line. Further, it would not be expected that the measured line widths of the $Xe^{34+}$ components shown in FIGS. 3 and 4 at λ≅2.88 Å (feature A) would be identical, since the former is influenced by the dynamics of the crystal damage while the latter is free of this effect.

Comparison of the stimulated spectra recorded axially with corresponding spectra measured in the direction transverse to the axis of the channel provides clear evidence for: (1) spectral line narrowing; (2) saturation of the amplification; and (3) the spectral correlation of these two phenomena. In particular, the axial spectrum #2 can be compared to transverse spectra that are recorded both with and without channel formation. With no channel formed, a significant scale length for amplification does not exist and the enhanced narrow spectral components described above and shown in FIG. 4 are not observed. The opposite is true when a channel is present. The formation of the channels can be easily controlled experimentally by a small adjustment in the focal position of the incident 248 nm pulse. The presence or absence of a channel is directly determined for every pulse through the recording of an x-ray pinhole camera image of the form shown in FIG. 2. For the data described below, the characteristic length of the channels produced was ~2 mm.

Figure 5A:
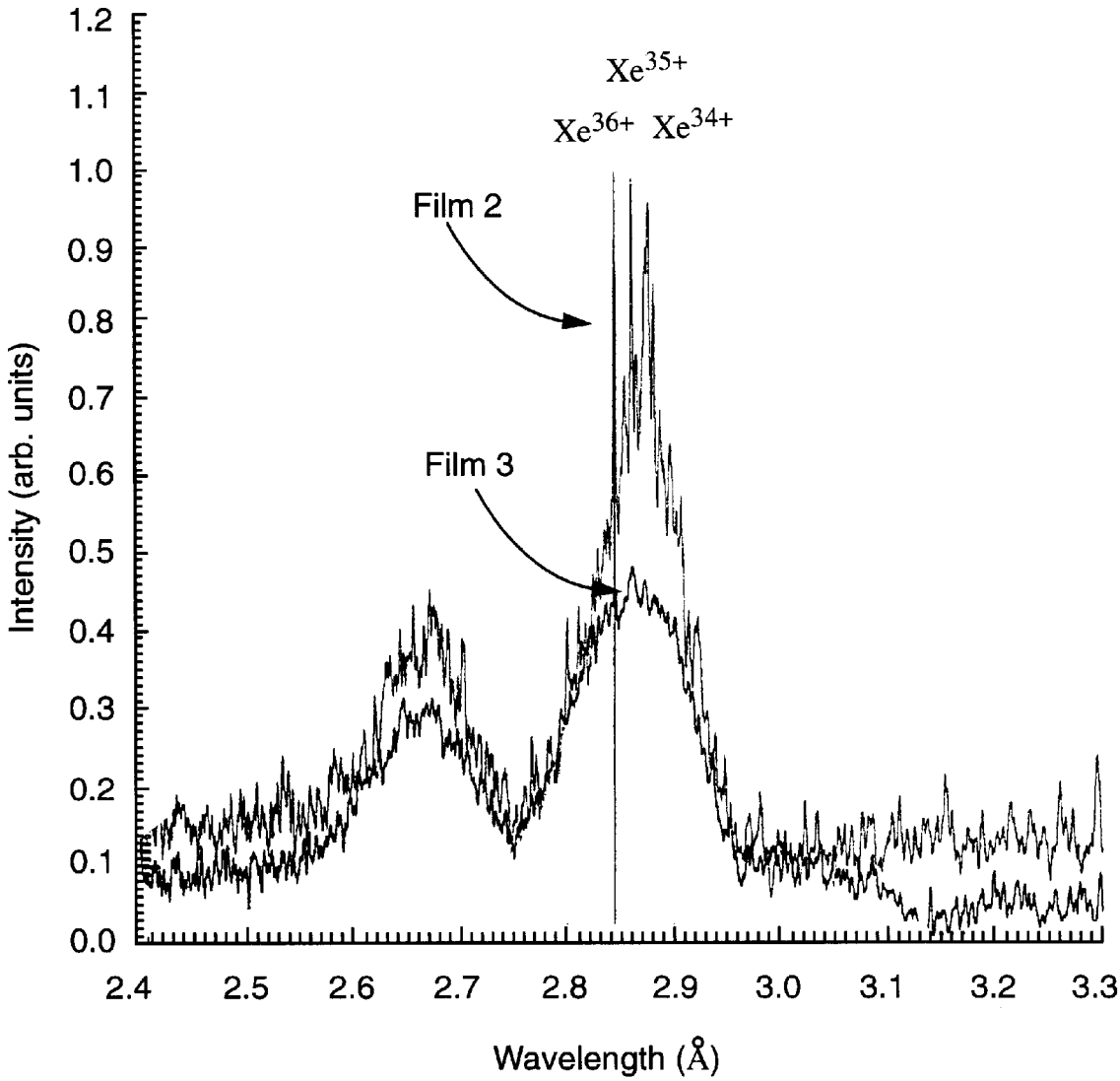
FIG. 5 shows a comparison of axially amplified spectrum (film #2) with a transversely emitted spectrum (film #3) recorded without the formation of channels. The inset shows the comparative widths (FWHM) of the respective components.
Figure 5B:
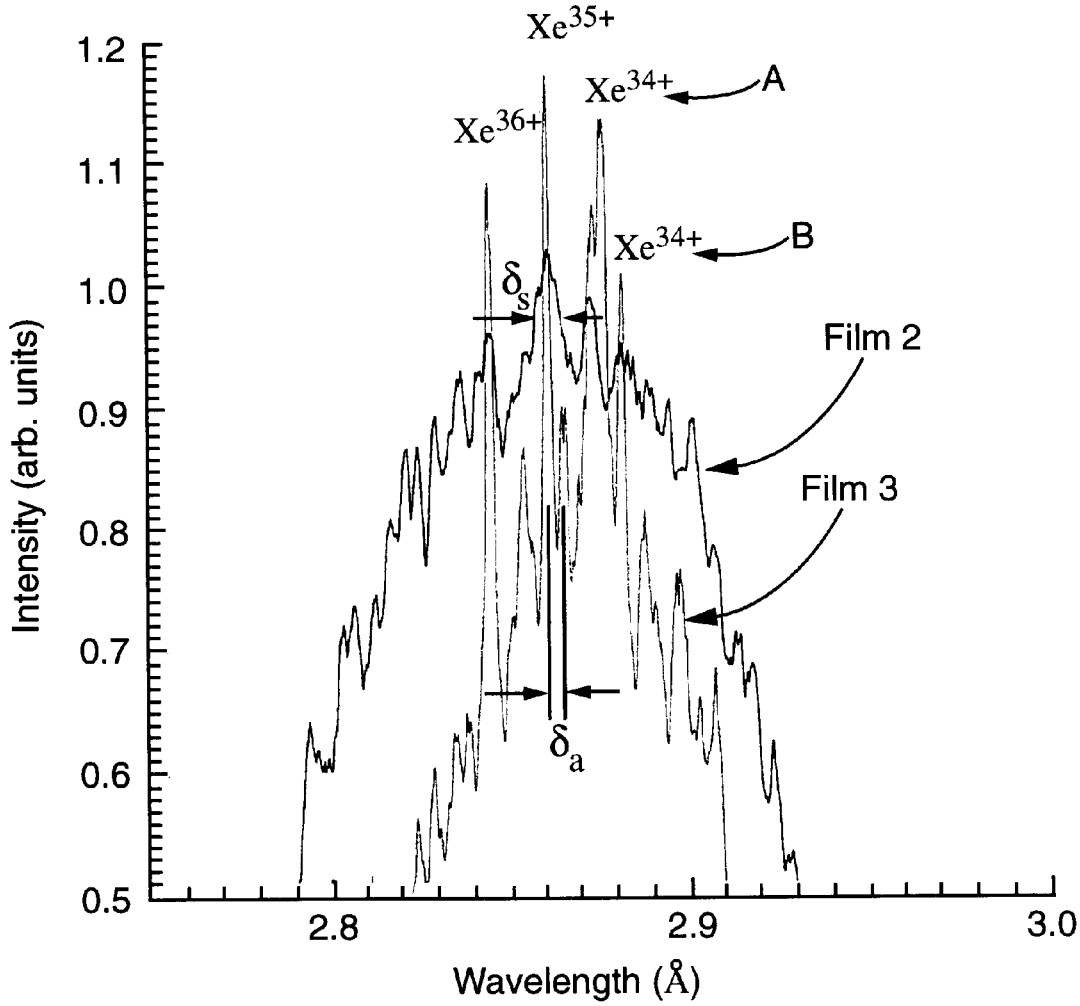

The comparison of the amplified spectrum #2 with a transverse spectrum produced without a channel (film #3) is shown in FIG. 5. The strong sharp amplified features that are distinctly illustrated in the forward spectrum in FIG. 4 are matched by far weaker transverse companions in this comparison. Specifically, it is evident that both the relative intensities and the spectral envelopes of the transitions are significantly altered. With respect to the relative strength observed transversely for the $Xe^{36+}$ transition in spontaneous emission, the corresponding axially amplified signal is enhanced by a factor of ~8.5. As shown in the inset of FIG. 5, it is also seen that the spontaneous emission width ($\delta_s$~11 eV) of the $Xe^{35+}$ feature recorded transversely is sharply narrowed in the amplified spectrum to a value (~4.5 eV) very close to the breadth (~4.4 eV) of the $Xe^{36+}$ line. Peak B of the $Xe^{34+}$ array exhibits a comparable narrowing. Component A of the $Xe^{34+}$ transition displays a marked spectral shift indicating that preferred amplification occurs on lines associated with the red wing of the complex, unresolved feature recorded in spontaneous emission.

Components A and B of the $Xe^{34+}$ array respectively exhibit a definitive spectral shift favoring the red wing and a manifest narrowing. The spectral splitting between two features attributed to the $Xe^{35+}$ array is denoted by $\delta \cong 7$ eV.

Figure 6:
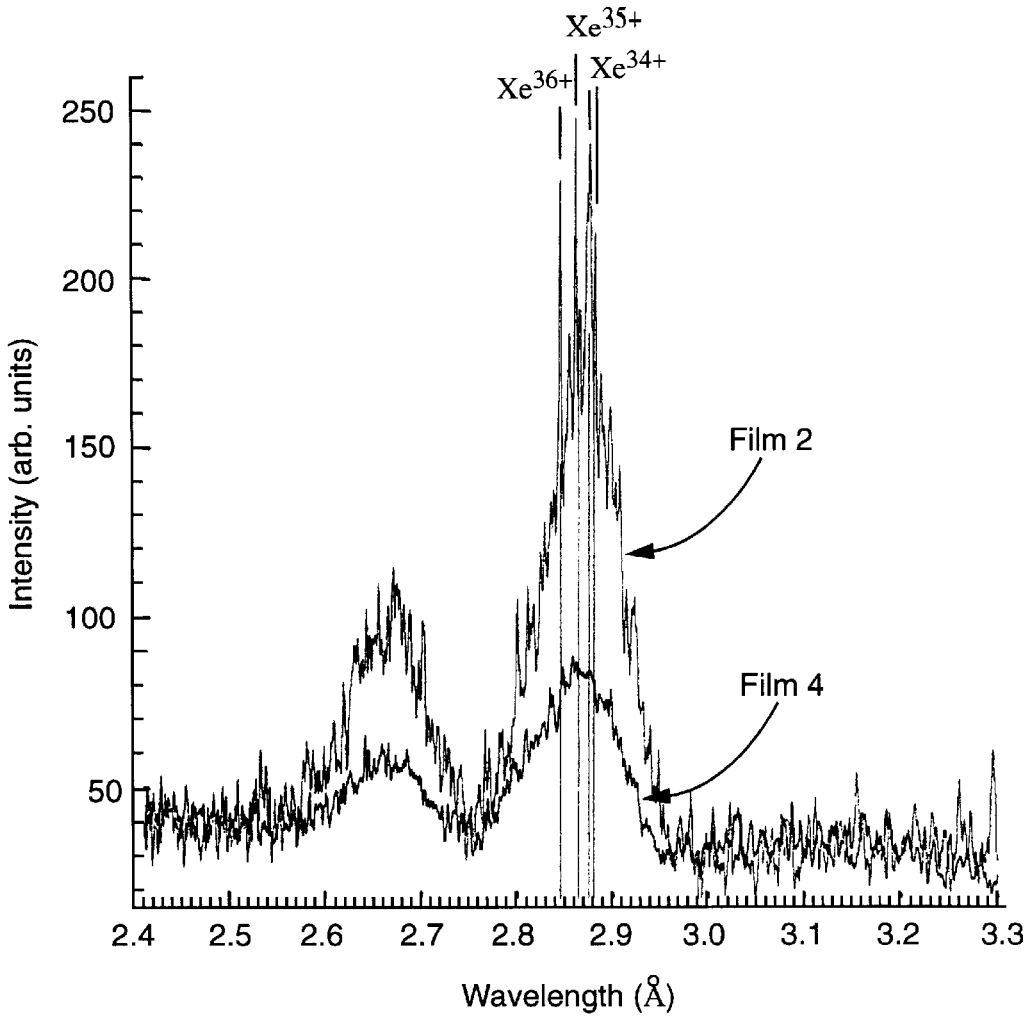
FIG. 6 shows a comparison of axially amplified spectrum (film #2) with a transversely emitted spectrum (film #4) recorded with the formation of channels.

The corresponding comparison of the axially amplified spectrum #2 with a transverse spectrum recorded when channels are produced (film #4) is shown in FIG. 6. It should be noted that the transverse spectrum shown in FIG. 6 is significantly altered with respect to the corresponding transverse spectrum #3 shown in FIG. 5; several peaks present in the latter are absent in the former. The direct comparison of these two transverse spectra (#3, without channels versus #4, with channels) is presented in FIG. 7 and the inset displays the detailed structure of this relative distortion. For the $Xe^{36+}$ feature, it is evident that the plainly visible peak present in spectrum #3 is converted into the strong dip appearing in spectrum #4. Therefore, the presence of the channeled propagation that produces the axially directed amplified spectrum simultaneously acts to substantially suppress the isotropic $Xe^{36+}$ emission. This represents strong evidence for saturation of the $Xe^{36+}$ transition. Further inspection of the spectral comparison reveals that the $Xe^{34+}$ and $Xe^{35+}$ components manifest similar behavior. The $Xe^{35+}$ transition that exhibits the sharp spectral narrowing detailed in the inset of FIG. 5 shows a strong structured suppression. Indeed, the suppressed $Xe^{35+}$ emission in spectrum #4 displays two adjacent minima with a spectral separation of $\delta_a \cong 7$ eV, a splitting that exactly matches the shift between the two amplified $Xe^{35+}$ components identified in FIG. 4. Additionally, both components (A and B) of the $Xe^{34+}$ array are likewise strongly quenched. Finally, the comparison also suggests the presence of additional spectral modulations in the 2.90–2.93 Å and 2.80–2.82 Å regions that remain to be analyzed. With reference to FIG. 4, the former correlates with the location of the $Xe^{31+}$, $Xe^{32+}$, and $Xe^{33+}$ transitions while the latter occupies the range in which several sharp unidentified features appear.

The interlocking properties of the comparative spectra illustrated in FIGS. 4–7 unambiguously demonstrate that the (3d→2p) transition arrays of all three charge states ($Xe^{34+}$, $Xe^{35+}$, and $Xe^{36+}$) are saturated, a property of strong amplification. This behavior conforms to the estimated range for the gain constant $g_L$, the observed channel lengths, the previous measurements establishing the properties of the cluster excitation [6,9,11,12,15,16], and the Xe target densities used.

Figure 7A:
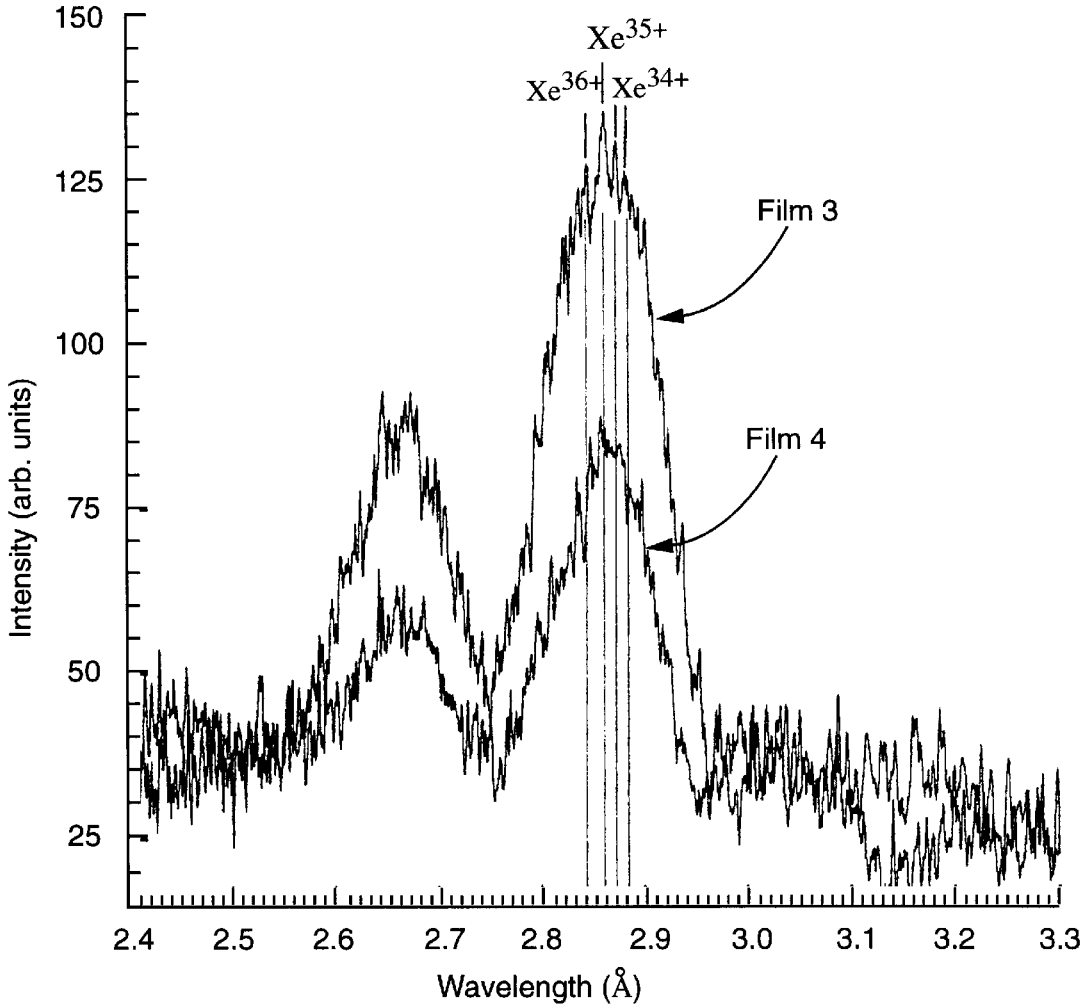
FIG. 7 shows spectral comparison of transversely emitted spontaneous emission with (film #4) and without (film #3) channel formation.
Figure 7B:
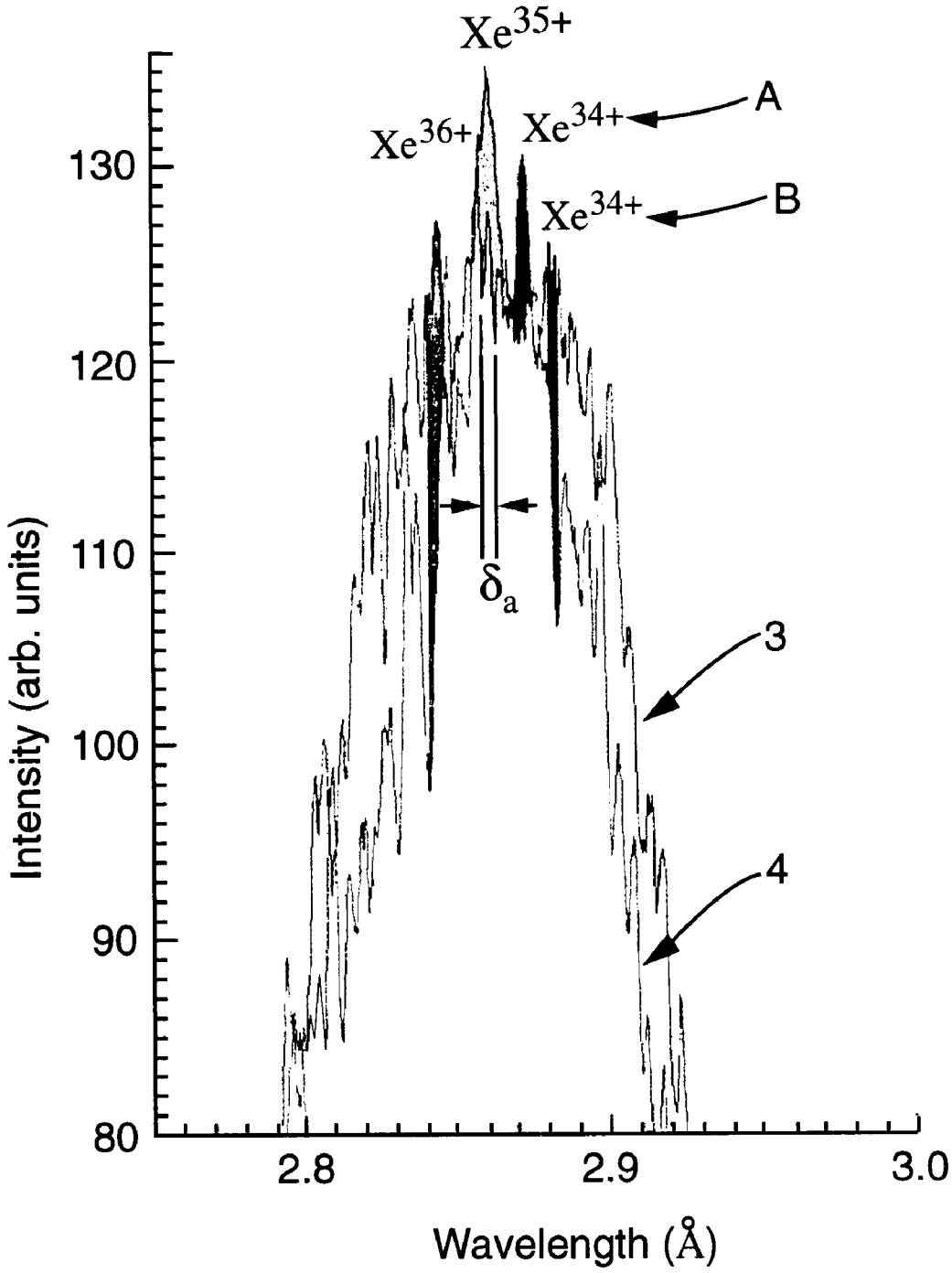

With a channel length of ~2 mm, the observation of saturation ($g_L I_{ch} \cong 10$) places the minimum value of the gain constant at $g_L \cong 50$ cm$^{-1}$. Additionally, since the loss length $I_{65}$ is estimated [18] to exceed ~0.5 cm, a high gain-to-loss ratio ($g_L I_\gamma > 25$) is also indicated. Indeed, the deep saturation exhibited by the spectral comparison shown in the inset of FIG. 7 gives confirming experimental evidence that the losses are low.

Figure 8:
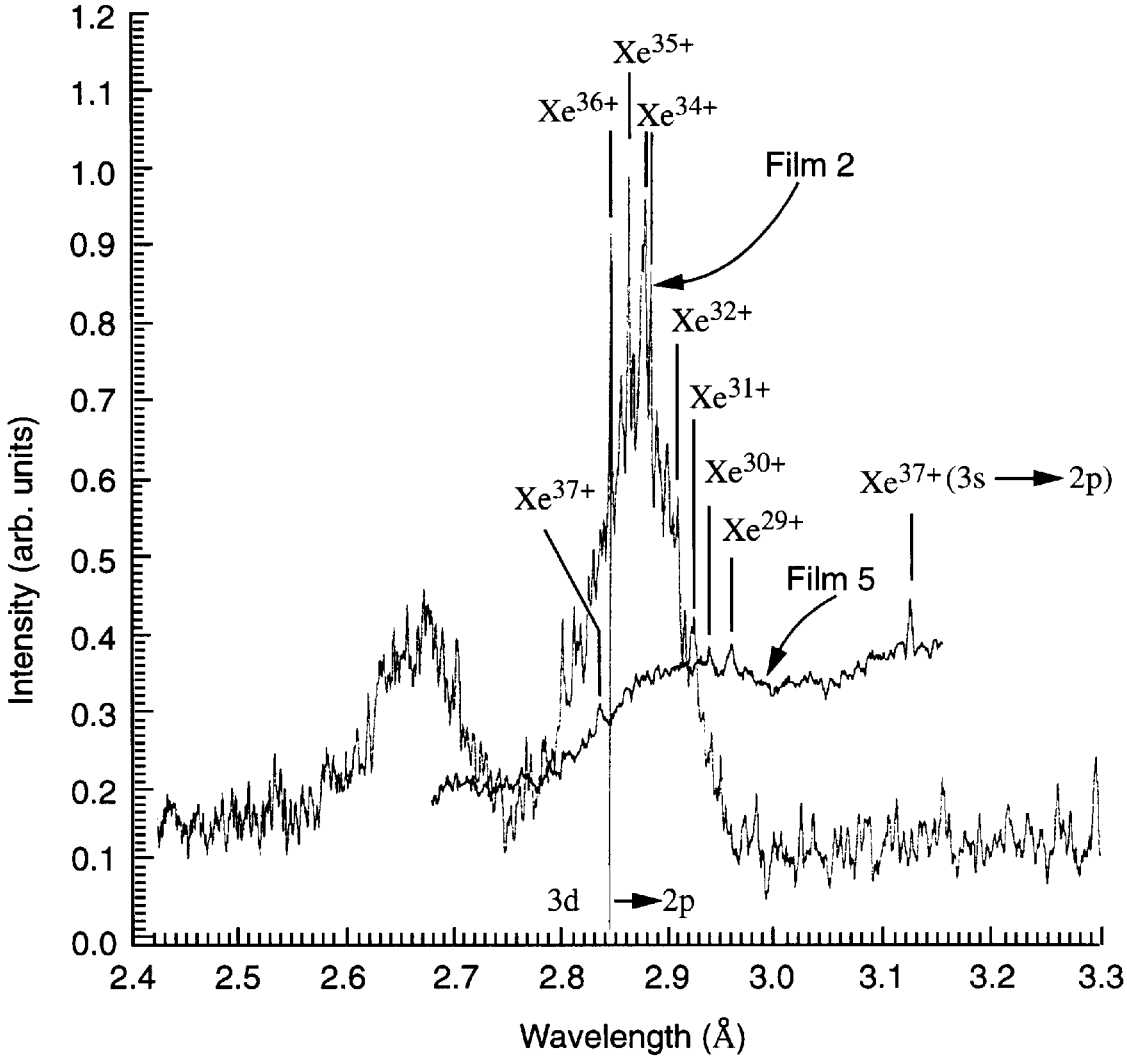
FIG. 8 shows a comparison of axially amplified spectrum (film #2) with the transverse spectrum of spontaneous emission imaged transversely specifically from the channel region (film #5) and reported in Ref. [9].

The phenomenon of saturated amplification described above introduces a basic anti-correlation into the comparison of axially and transversely observed spectra; strongly amplified transitions appear suppressed in the transverse direction from the channel. Accordingly, the opposite should also be true; transitions that are prominent in transverse spectra from the channels should not exhibit strong amplification. In addition to the results described above, this conclusion can be further verified by comparison with spectra recorded in earlier studies [9] that concentrated on spatially resolving the Xe(L) spectrum radiated solely from the isolated channel zone in the transverse direction. From this spectrum (film #5) of the Xe(L) emission, which is shown in FIG. 8 in conjunction with the amplified spectrum #2, it may be observed that the four lines identified in the inset were prominent in the transverse emission. A direct comparison of these two spectra reveals that there is no evidence for enhancement of these four transitions in the axially amplified spectrum #2. On spectroscopic grounds, both $Xe^{37+}$ lines are poorly suited for amplification. The (3s→2p) transition at $\lambda$=3.12 Å has a much smaller cross section for stimulated emission, since the radiative lifetime is long (~65 fs) in comparison to the (3s→2p) lines (~1.8 fs).

The $Xe^{37+}$ (3s→2p) line at $\lambda$=2.83 Å is also expected to present insignificant amplification, since this transition appears at a relatively low position of the blue wing of the Xe(L) spectrum and the three open shells in the upper state electron configuration ($2p^5 3s^2 3p^5 3d$) generate a relatively large multiplicity in the transition array [20] which significantly dilutes the spectral density in comparison to the (3d→2p) arrays that have a closed 3p shell (e.g., $Xe^{36+}$). With reference to the $Xe^{29+}$ and $Xe^{30+}$ transitions, spectrum #3 shown in FIG. 6 discloses that these components have a strength comparable to only ~10% of the $Xe^{34+}$ component, so that the relative gain of these transitions would be insignificant. Conversely, careful inspection of the right wing of the axially recorded spectrum #2 provides evidence for amplification on the $Xe^{31+}$, $Xe^{32+}$ and $Xe^{33+}$ arrays, transitions that are not evident in the transverse emission (#5) from the channel. It may also be again observed that the signature of saturation illustrated in FIGS. 6 and 7, specifically, the presence of the dip in transverse spectrum #5 that coincides with the wavelength of the amplified $Xe^{36+}$ line.

In summary, the spectral pattern presented by a combined reading of the data appearing in FIGS. 3–8 supports the conclusion that the $Xe^{31+}$, $Xe^{32+}$, $Xe^{33+}$, $Xe^{34+}$, $Xe^{35+}$, and $Xe^{36+}$ transition arrays in the 2.85–2.93 Å region all display observable amplification with the latter three species ($Xe^{34+}$, $Xe^{35+}$, and $Xe^{36+}$) dominating and exhibiting distinct saturation.

Figure 9:
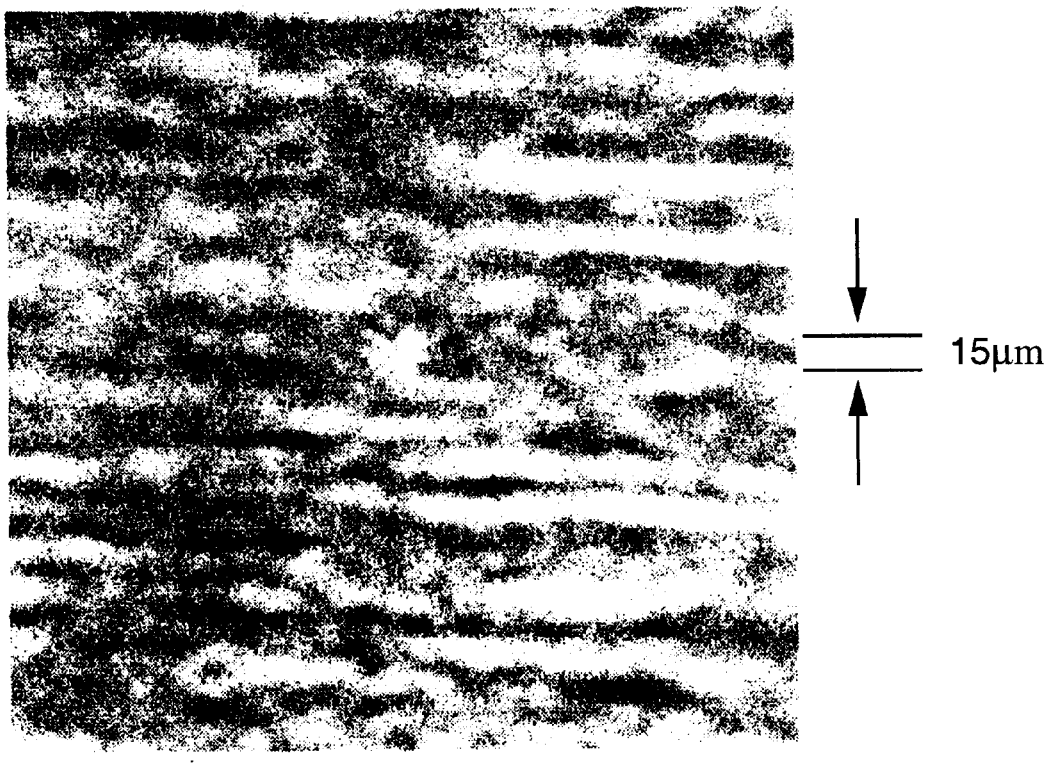
FIG. 9 shows the morphology of observed damage in 12.5 $\mu$m thick Ti foils. An isolated hole with a diameter of ~15 $\mu$m viewed from the back surface of the foil is shown. For reference, a scale bar indicating a length of 15 $\mu$m is shown.

The damage produced in the 12.5 μm thick Ti foils provides information on both the x-ray pulse energy and the angular divergence of the beam. These foils, which served to isolate the von Hámos spectrograph from all radiation with wavelengths greater than ~5 Å, were located at ~2.5 cm from the channel formed in the gaseous target with an orientation perpendicular to the axial direction of the x-ray propagation. The detailed morphology of the observed damage to the Ti foils is illustrated in FIG. 9. The diameter of the individual holes, as represented by the isolated feature shown in FIG. (8), is approximately 15 μm. The experiments have shown that, although channels are readily formed, the direction of propagation can vary substantially, behavior that naturally leads to a dispersion of damaged areas on the Ti foil. A likely source of this variability in directionality is the presence of small fluctuations on the spatial wavefront of the incident 248 nm pulse whose influence is amplified by the strong nonlinearity associated with the channeling mechanism [7,8,17].

With the assumption of approximately fifty percent absorption [18] of the radiation by the foil, the creation of a hole with a diameter of ~15 μm implies a pulse energy of at least $E_L$~15–20 μJ. This energy can be compared to the minimum value expected to be produced by a saturated amplifier. Based on a radiative width [20] of ~2 eV and a measured inhomogeneous width for the full Xe(L) band [5,6] of ~180 eV, the stimulated emission cross section is estimated to be $\sigma_L 1.5\times10^{18}$ cm$^2$, a magnitude which gives an areal saturation energy of ~230 J·cm$^{-2}$. Since the channels [4, 7,8,12,17] are expected to have an effective diameter of δ~3 μm, the minimum saturation energy indicated is ~16 μJ. Since this value closely matches the requirement for the observed damage in the foil, it provides a physical basis for the correlation of saturated amplification with foil damage. At a distance of ~2.5 cm, a 15 μm feature indicates a corresponding angular divergence of Δθ~0.6 mr.

Electrons accelerated by a laser wakefield in the forward direction are ruled out as the source of the damage to the Ti foils on several experimental grounds. Studies of the coupling of the 248 nm radiation to Xe cluster targets [10] have shown that the principal channel for energy deposition is excitation of the clusters, not plasma modes. Other studies, conducted with infrared radiation (810 nm and 1.06 μm) and unclustered low-Z targets [21,22], have demonstrated both: (1) that the number of accelerated electrons [22] is very small (~$10^5$) and (2) that the emittance of the electrons produced is approximately 100-fold too large to account for the pattern of damage produced in the Ti foils. Hence, the measured properties [21,22] of electrons accelerated in channels do not enable them to produce the concentrated beam of energy necessary to produce the holes observed in the foils.

Figure 10:
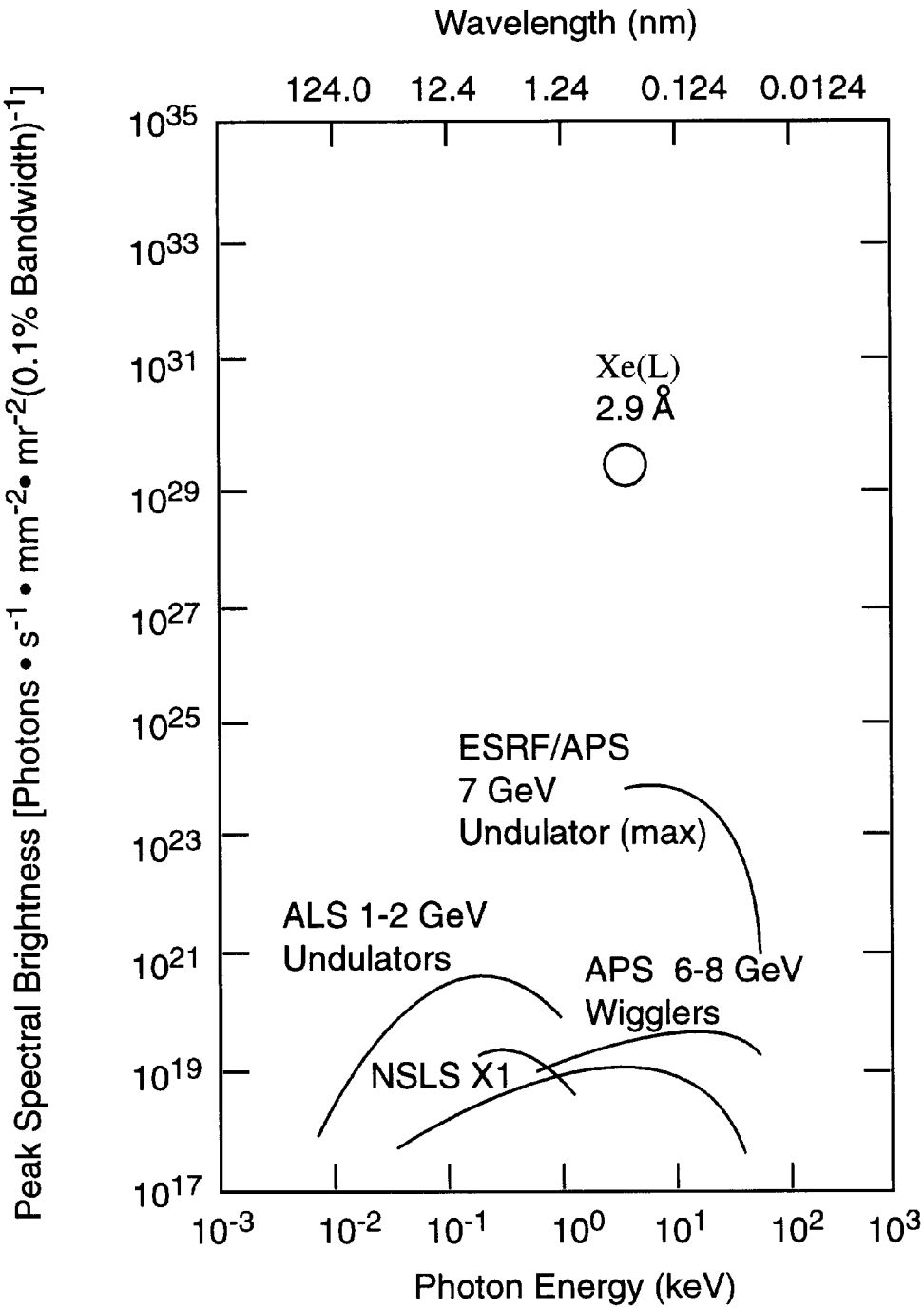
FIG. 10 shows the estimated peak brightness for the 2.9 Å Xe(L) source in comparison to available synchrotron technology.

The experimental evidence cited above can be used to estimate the peak brightness of the 2.9 Å source for comparison with the corresponding figure produced by available synchrotron technology [3]. In order to do so, an estimate of the x-ray temporal pulse width T is necessary. An upper bound for this timescale is given by the integrity of the plasma channel [17]. This consideration sets the upper limit at τ~100 fs, although a considerably lower value is expected on the basis of the dynamics of saturated amplification in the channel. Accordingly, with $E_L$≅20 μJ, Δθ≅0.6 mr, 67 =3 μm, and τ≅100 fs, and an x-ray bandwidth factor of approximately unity that is based on the sharpness of the amplified spectral features (e.g., $Xe^{36+}$) illustrated in FIG. 4, the estimated magnitude of the peak brightness is B≅$10^{29}$ γ·s$^{-1}$·mm$^{-2}$·mr$^{-2}$(0.1% Bandwidth)$^{-1}$. As shown in FIG. 10, this value is approximately $10^5$-fold greater than available synchrotron sources.

It should be noted that the cooperative alliance [4] formed by the two physical processes described above has a fundamental physical basis that is the core of the concept; it is not an accidental arrangement. Two unusual forms of radiatively excited systems: the hollow atoms produced from the clusters and the self-trapped channels have a basic underlying structural relationship that enables the amplification to be successfully achieved. They can be considered as two examples of a single class of highly excited ordered matter [23]. Specifically, they represent 3D and 2D systems, respectively, whose corresponding excitation energies are derived from the symmetric displacement of electronic charge. From this structural similarity, it can be shown [4] that the system comprised of the plasma channel and the atomic cluster medium can be arranged so that essentially identical conditions are required to excite both of these forms of highly energetic matter. This outcome enables the formation of the confined channels under circumstances for which multikilovolt emission from hollow atoms perforce is simultaneously and optimally generated within them with the example of Xe(L) emission at λ~2.9 Å.

Since the strongly nonlinear mechanism of cluster excitation and saturated amplification are both radiation dominated processes, nonradiative modes of loss are weakly coupled and a very auspicious setting prevails generally for the efficient transfer of energy from the incident ultraviolet (248 nm) wave to the coherent x-ray beam. Accordingly, with the dominance of these radiative couplings and the demonstration of both high gain ($g_L$≧50 cm$^{-1}$) and a high gain-to-loss ratio ($g_L I_\gamma$≧25), it may be concluded that a favorable situation exists for the achievement of substantially higher brightness figures and the extension of coherent amplification to considerably shorter wavelengths.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

REFERENCES

1. J. C. Solem and G. C. Baldwin, "Microholography of Living Organisms," Science 218, 229 (1982).
2. K. Boyer, J. C. Solem, J. W. Longworth, A. B. Borisov, and C. K. Rhodes, "Biomedical Three-Dimensional Holographic Microimaging at Visible, Ultraviolet, and X-Ray Wavelengths," Nature Medicine 2, 939 (1996).
3. R. Tatchyn, J. Arthur, R. Boyce, A Fasso, J. Montgomery, V. Vylet, D. Walz, R. Yotam, A. K. Freund, and M. Howells, "X-Ray Optics Design Studies for the SLAC 1.5–15 Å Linac Coherent Light Source," Nucl. Instr. and Meth. Phys. Res. A429, 397 (1999).
4. A. B. Borisov, A. McPherson, B. D. Thompson, K. Boyer, and C. K. Rhodes, "Ultrahigh Power Compression for X-Ray Amplification: Multiphoton Cluster Excitation Combined with Non-Linear Channeled Propagation, "J. Phys. B28, 2143 (1995).
5. A. McPherson, B. D. Thompson, A. B. Borisov, K. Boyer, and C. K. Rhodes, "Multiphoton-Induced X-Ray Emission at 4–5 keV from Xe Atoms with Multiple Core Vacancies," Nature 370, 631 (1994).

6. K. Kondo, A. B. Borisov, C. Jordan, A. McPherson, W. A. Schroeder, K. Boyer, and C. K. Rhodes, "Wavelength Dependence of Multiphoton-Induced Xe(M) and Xe(L) Emissions from Xe Clusters," J. Phys. B30, 2707 (1997).
7. A. B. Borisov, A. V. Borovskiy, V. V. Korobkin, A. M. Prokhorov, O. B. Shiryaev, X. M. Shi, T. S. Luk, A. McPherson, J. C. Solem, K. Boyer, and C. K. Rhodes, "Observation of Relativistic and Charge-Displacement Self-Channeling of Intense Subpicosecond Ultraviolet (248 nm) Radiation in Plasmas," Phys. Rev. Left. 68, 2309(1992).
8. A. B. Borisov, J. W. Longworth, K. Boyer, and C. K. Rhodes, "Stable Relativistic/Charge-Displacement Channels in Ultrahigh Power Density (~$10^{21}$ W/cm$^3$) Plasmas," Proc. Nat. Acad. Sci. USA 95, 7854 (1998).
9. A. B. Borisov, A. McPherson, K. Boyer, and C. K. Rhodes, "Z-λ Imaging of Xe(M) and Xe(L) Emissions from Channeled Propagation of Intense Femtosecond 248 nm Pulses in a Xe Cluster Target," J. Phys. B29, L113 (1996).
10. A. McPherson, A. B. Borisov, K. Boyer, and C. K. Rhodes, "Competition between Multiphoton Cluster Excitation and Plasma Wave Raman Scattering at 248 nm," J. Phys. B29, L291 (1996).
11. A. B. Borisov, A. McPherson, K. Boyer, and C. K. Rhodes, "Intensity Dependence of the Multiphoton-Induced Xe(L) Spectrum Produced by Subpicosecond 248 nm Excitation of Xe Clusters," J. Phys. B29, L43 (1996).
12. A. McPherson, I. Cobble, A. B. Borisov, B. D. Thompson, F. Omenetto, K. Boyer, and C. K. Rhodes, "Evidence of Enhanced Multiphoton (248 nm) Coupling from Single-Pulse Energy Measurements of Xe(L) Emission Induced from Xe Clusters," J. Phys. B30, L767 (1997).
13. A. B. Borisov, X. Shi, V. B. Karpov, V. V. Korobkin, J.C. Solem, O. B. Shiryaev, A. McPherson, K. Boyer, and C. K. Rhodes, "Stable Self-Channeling of Intense Ultraviolet Pulses in Underdense Plasma Producing Channels Exceeding 100 Rayleigh Lengths," JOSA B11, 1941 (1994).
14. K. Boyer and C. K. Rhodes, "Atomic Inner-Shell Excitation Induced by Coherent Motion of Outer-Shell Electrons," Phys. Rev. Left. 54, 1490 (1985).
15. W. Andreas Schroeder, F. G. Omenetto, A. B. Borisov, J. W. Longworth, A. McPherson, C. Jordan, K. Boyer, K. Kondo and C. K. Rhodes, "Pump Laser Wavelength-Dependent Control of the Efficiency of Kilovolt X-Ray Emission from Atomic Clusters," J. Phys. B31, L5031 (1998).
16. W. A. Schroeder, T. R. Nelson, A. B. Borisov, I. W. Longworth, K. Boyer, and C. K. Rhodes, " An Efficient, Selective Collisional Ejection Mechanism for Inner-Shell Population Inversion in Laser-Driven Plasmas," submitted to J. Phys. B.
17. A. B. Borisov, A. V. Borovskiy, O. B. Shiryaev, V. V. Korobkin, A. M. Prokhorov, J. C. Solem, T. S. Luk, K. Boyer, and C. K. Rhodes, "Relativistic and Charge-Displacement Self-Channeling of Intense Ultrashort Laser Pulses in Plasmas," Phys. Rev. A45, 5830 (1992).
18. E. F. Plechaty, D. E. Cullen, and R. J. Howerton, "Tables and Graphs of Photon-Interaction Cross Sections from 0.1 keV to 100 MeV Derived from the LLL Evaluated-Nuclear-Data Library," Rev. 3, Vol. 6 (UCRL-50400), (1981).
19. F. G. Omenetto, K. Boyer, J. W. Longworth, A. McPherson, T. Nelson, P. Noel, W. A. Schroeder, C. K. Rhodes, S. Szatmari, and G. Marowsky, "High Brightness Terawaft KrF* (248 nm) System, " Applied Optics B21, 43 (1997).
20. R. D. Cowan, The Theory of Atomic Structure and Spectra (University of California Press, Berkeley, Calif., 1982).
21. R. Wagner, S.-Y. Chen, A. Maksimchuk, and D. Umstadter, "Electron Acceleration by a Laser Wakefield in a Relativistically Self-Guided Channel," Phys. Rev. Left. 78, 3125(1997).
22. Xiaofang Wang, Mohan Krishnan, Wed Saleh, Haiwen Wang, and Donald Umstadter, "Electron Acceleration and the Propagation of Ultrashort High-Intensity Laser Pulses in Plasmas," Phys. Rev. Left. 84, 5324 (2000).
23. G. Marowsky and Ch. K. Rhodes, "Hohle Atome-Eine Neue Form von Hochangeregter Materie," Neue Zürcher Zeitung, Nr. 254, 1. November 1995, S. 42.

What is claimed is:

1. A method for generating laser radiation in the x-ray region of the electromagnetic spectrum which comprises the steps of:

(a) generating pulsed laser radiation having a chosen intensity and wavelength;

(b) generating gaseous atomic clusters having a chosen density and size;

(c) directing the laser radiation into the gas clusters whereby multiphoton coupling with the clusters occurs producing rapid atomic excitation, thereby removing selected inner-shell atomic electrons without removing all of the electrons in the next outermost shell with the consequent generation of a population inversion, and whereby a region of nonlinear, mode-confined propagation for x-radiation is established; and (d) controlling the density of gaseous atomic clusters in the region of nonlinear, mode-confined propagation such that the x-radiation propagation therein is not extinguished.

2. The method as described in claim 1, wherein the cluster size is chosen to minimize the laser intensity required to excite substantially all of the atoms in the cluster.

3. The method as described in claim 1, wherein the pulse width of the laser is chosen such that atomic excitation occurs on a timescale which is short compared with recombination processes in the atomic plasma produced.

4. The method as described in claim 3, wherein the pulse width is less than 1 picosecond.

5. The method as described in claim 1, wherein the intensity and wavelength of the laser radiation, and the atomic species in the clusters are chosen according to the wavelength desired for the generated x-rays.

6. The method as described in claim 5, wherein the wavelength of the laser radiation is less than 300 nm.

7. The method as described in claim 5 wherein the laser radiation has a power level greater than 1 TW per pulse.

8. The method as described in claim 6, wherein the atoms in the atomic clusters are heavy atoms.

9. The method as described in claim 8, wherein the atoms in the atomic clusters are selected from the group consisting of Ar, Kr, Xe, Au, Bi, Th, Pb, U, and mixtures thereof.

10. The method as described in claim 1, wherein the atomic clusters contain atoms bound in molecules.

11. The method as described in claim 1, wherein the molecules are selected from the group consisting of $N_2$, $I_2$, and $UF_6$.

12. The method as described in claim 1, wherein said step of controlling the density of gaseous atomic clusters comprises sharply reducing the density of gaseous atomic clusters at a chosen location along the direction of propagation of x-radiation for which the region of nonlinear, mode-confined propagation is established over the density of gaseous atomic clusters within the remainder of the region.

13. An apparatus for generating laser radiation in the x-ray region of the electromagnetic spectrum which comprises in combination:

(a) means for generating pulsed laser radiation having a chosen intensity and wavelength;

(b) means for generating gaseous atomic clusters having a chosen density and size;

(c) means for directing the laser radiation into the gas clusters whereby multiphoton coupling with the clusters occurs producing rapid atomic excitation, thereby removing selected inner-shell atomic electrons without removing all of the electrons in the next outermost shell with the consequent generation of a population inversion and the establishment of a region of nonlinear, mode-confined propagation for x-radiation; and (d) means for controlling the density of gaseous atomic clusters in the region of nonlinear, mode-confined propagation such that the x-radiation propagation therein is not extinguished.

14. The apparatus as described in claim 13, wherein said means for controlling the density of gaseous atomic clusters comprises means for sharply reducing the density of gaseous atomic clusters at a chosen location along the direction of propagation of x-radiation in which the region of nonlinear, mode-confined propagation for x-radiation is established over the cluster density within the remainder of the region.

* * * * *